US008604991B2

(12) United States Patent
Nagayama

(10) Patent No.: US 8,604,991 B2
(45) Date of Patent: Dec. 10, 2013

(54) TWO-DIMENSIONAL ANTENNA ARRAY FOR MICROWAVE IMAGING

(75) Inventor: Yoshio Nagayama, Mizunami (JP)

(73) Assignee: Inter-University Research Institute National Institutes of Natural Sciences, Mitaka-Shi, Tokyo (JP)

( * ) Notice: Subject to any disclaimer, the term of this patent is extended or adjusted under 35 U.S.C. 154(b) by 835 days.

(21) Appl. No.: 12/496,800

(22) Filed: Jul. 2, 2009

(65) Prior Publication Data

US 2010/0060537 A1 Mar. 11, 2010

(30) Foreign Application Priority Data

Sep. 5, 2008 (JP) ..... 2008-228479

(51) Int. Cl.
*H01Q 13/00* (2006.01)

(52) U.S. Cl.
USPC ..... 343/776; 343/772; 343/774

(58) Field of Classification Search
USPC ..... 343/776
See application file for complete search history.

(56) References Cited

U.S. PATENT DOCUMENTS

| | | | | |
|---|---|---|---|---|
| 4,370,659 | A | 1/1983 | Chu et al. | |
| 4,411,022 | A * | 10/1983 | Clifton et al. | 455/327 |
| 4,571,593 | A * | 2/1986 | Martinson | 343/783 |
| 5,341,138 | A | 8/1994 | Ono et al. | |
| 5,825,333 | A | 10/1998 | Kudo et al. | |
| 6,049,313 | A | 4/2000 | Sawada et al. | |
| 6,181,278 | B1 * | 1/2001 | Kakimoto et al. | 343/700 MS |
| 2002/0057226 | A1 | 5/2002 | Koh et al. | |
| 2004/0085249 | A1 * | 5/2004 | Kitamori et al. | 343/776 |
| 2005/0264448 | A1 | 12/2005 | Cox et al. | |

FOREIGN PATENT DOCUMENTS

| | | |
|---|---|---|
| JP | 59-055605 | 3/1984 |
| JP | 60-192401 | 9/1985 |
| JP | 64-017502 | 1/1989 |
| JP | 05-251928 | 9/1993 |
| JP | 05-308219 | 11/1993 |
| JP | 10-341113 | 12/1998 |
| JP | 2003-133816 | 5/2003 |

(Continued)

OTHER PUBLICATIONS

"Arrays: Linear Planar and Circular," Antenna Theory Analysis and Design, 3rd Edition, Constantine Balanis, 2005, pp. 283 to 371.*

(Continued)

*Primary Examiner* — Jacob Y Choi
*Assistant Examiner* — Graham Smith
(74) *Attorney, Agent, or Firm* — Workman Nydegger

(57) ABSTRACT

An antenna array provided with two frames which form waveguides. Each frame includes a plate portion and frame portion. The plate portion includes grooves laid out next to one another. Each groove has an open end and a closed end. The frame portion is arranged adjacent to the plate portion. The frame portion has an opening that opens in a direction perpendicular to a direction in which the grooves extend and a direction in which the grooves are laid out. A dielectric substrate is held between the two frames. The dielectric substrate includes an array of feeders and electronic circuits, each circuit having a discrete active element. The circuits are exposed from the opening of either one of the frames. The frames are superimposed with the dielectric substrate so that the grooves form the waveguides. Each circuit is electromagnetically connected to a corresponding one of the waveguides.

10 Claims, 4 Drawing Sheets

(56) References Cited

FOREIGN PATENT DOCUMENTS

| | | |
|---|---|---|
| JP | 2008-501293 | 1/2008 |
| WO | 98/43314 | 10/1998 |
| WO | WO 2007/122413 | 11/2007 |

OTHER PUBLICATIONS

B. Veidt, et al "Diagonal horn integrated with micromachined waveguide for submillimetre applications" Electronic Letters, vol. 31, No. 16, Aug. 3, 1995; pp. 1307-1309, XP006003160 ISSN:0013-5194.

Michael D. Audley, et al "TES imaging array technology for CℓlOVER" Millimeter and Submillimeter Detectors and Instrumentation for Astonomy III, vol. 6275, Jun. 14, 2006, p. 627524-1-627524-9; XP002538556, Orlando, FL, USA.

Tomas Sehm, et al "A High-Gain 58-GHz Box-Horn Array Antenna with Suppressed Grating Lobes" IEEE Transactions on Antennas and Propagation, vol. 47, No. 7, Jul. 1999, pp. 1125-1130.

Gabriel M. Rebeiz, et al "Monolithic Millimeter-Wave Two-Dimensional Horn Imaging Arrays" IEEE Transactions on Antennas and Propagation, vol. 38, No. 9. Sep. 1990, pp. 1473-1482.

K. Sigfrid Yngvesson, et al "The Taperes Slot Antenna—A New Integrated Element for Millimeter-Wave Applications" IEEE Transactions on Microwave Theory and Techniques, vol. 37, No. 2, Feb. 1989, pp. 365-374.

* cited by examiner

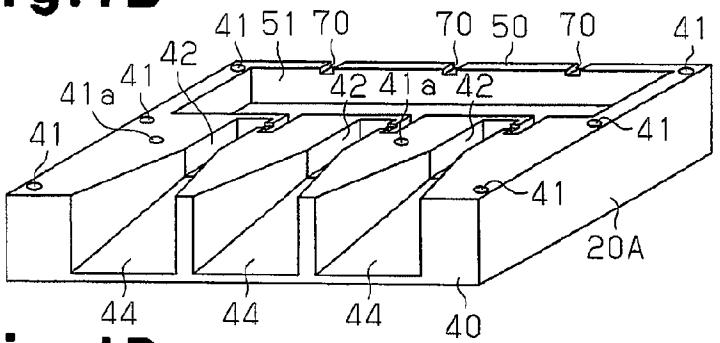
41
41
41

TWO-DIMENSIONAL ANTENNA ARRAY FOR MICROWAVE IMAGING

CROSS-REFERENCE TO RELATED APPLICATIONS

This application is based upon and claims the benefit of priority from the prior Japanese Patent Application No. 2007-228479, filed on Sep. 5, 2008, the entire contents of which are incorporated herein by reference.

BACKGROUND OF THE INVENTION

The present invention relates to an antenna array.

A microwave antenna array is widely applied to the field of high-speed scanning radars and microwave imaging. For example, a high-speed scanning radar is applied to radars for detecting flying objects, compact radars, and the like. Microwaving imaging is applied to nondestructive tests, medical diagnoses, temperature imaging enabling low temperature detection, and the like.

The use of a waveguide antenna in a microwave antenna array has been proposed in the prior art. Japanese Laid-Open Patent Publication No. 5-308219 describes a waveguide antenna. In the waveguide antenna described in the publication, a horn antenna is arranged on one side of a dielectric printed circuit.

Known waveguide antennas are described in following documents [1] to [3]:

[1] T. Sehm, A. Lehto, A. V. Raisanen, "A High-Gain 58-GHz Box-Horn Array Antenna with Suppressed Grating Lobes", IEEE Trans. Antenna Prop., vol. 47, pp. 1125-1130 (1999);

[2] G. M. Rebeitz, D. P. Kasilingam, Y. Guo, P. A. Stimson, D. B. Ruttledge, "Monolithic Millimeter-Wave Two-Dimensional Horn Imaging Arrays", IEEE Trans. Antenna Prop., vol. 38, pp. 1473-1482 (1990); and

[3] K. Sigfrid Yngvesson et al., "The Tapered Slot Antenna—A New Integrated Element for Millimeter-wave Applications", IEEE Trans. Microwave Theory Tech., vol. 37, pp. 365-374 (1989).

In the two-dimensional antenna array proposed in document [1], feeder circuit portions are arranged on a single printed substrate, and a horn antenna is arranged on the feeder circuit portions. In the two-dimensional antenna array proposed in document [2], for application to a microwave imaging detector, a thin film including a feeder circuit portion is arranged between a horn antenna and a back cavity. In document [3], an active microwave antenna array including a tapered slot antenna and an active electronic circuit arranged on a substrate is proposed as a two-dimensional millimeter-wave imaging element.

The applicant of the present application has proposed in Japanese Patent Application No. 2008-039009 an active microwave antenna array that arranges Yagi-Uda antennas on a plane. The active microwave antenna array may be applied to microwave imaging reflectometry measurements. A microwave refers to an electromagnetic wave of which frequency is 3 GHz to 300 GHz (one millimeter to ten centimeter in wavelength). The frequency of about 30 GHz to 300 GHz has a wavelength of several millimeters and is also referred to as a millimeter-wave. However, in this specification, microwaves include millimeter-waves.

The prior art structures have the problems described below.

In Japanese Laid-Open Patent Publication No. 5-308219, the horn antenna and waveguide are arranged on one side of the printed circuit substrate, and the horn antenna is arranged on the surface of the dielectric substrate. A feeder (mixer diode) projects perpendicular to the substrate. An intermediate frequency circuit and the like are arranged on the rear surface of the dielectric substrate. Therefore, it is difficult to use active elements, such as mixer diode chips, that are suitable for mass production.

In the antenna array of document [1], only feeders are arranged on the printed circuit substrate, and there is no space for active elements. Thus, the antenna array cannot be used for high-sensitivity imaging receivers.

In the waveguide antenna array of document [2], the space for electronic circuits is extremely small. Thus, to actually lay out electronic circuits, micro-fabrication techniques for fabricating semiconductor integrated circuits are required.

The tapered slot antenna may be used for a wide band. However, each of the waveguide antennas are large. Thus, when a large number of waveguide antennas are arranged to form an imaging element, the spatial resolution becomes low.

The planar Yagi-Uda antenna proposed by the applicant of the present application has a satisfactory spatial resolution. However, in the array structure, interference between adjacent antenna elements occurs and forms deep notch in the frequency characteristics. Thus, the planar Yagi-Uda antenna is not suitable for a wide band antenna that performs frequency sweeping. Further, the printed circuit substrate is thin and lacks mechanical strength.

SUMMARY OF THE INVENTION

The present invention provides an antenna array that ensures layout space for discrete active elements, maintains the necessary mechanical strength, and reduces the pitch between antennas.

One aspect of the present invention is an antenna array including two frames which form an array of waveguides. Each of the frames includes a plate portion including an array of grooves laid out next to one another. Each of the grooves has an open end and a closed end. A frame portion is arranged adjacent to the plate portion at the closed end side of the grooves. The frame portion has an opening that opens in a direction perpendicular to both of a direction in which the grooves extend and a direction in which the grooves are laid out. A dielectric substrate is held between the two frames by the plate portion and the frame portion of each of the frames. The dielectric substrate includes an array of feeders and electronic circuits, each electronic circuit having a discrete active element. The array of electronic circuits is exposed from the opening of at least either one of the frames. The frames are superimposed with the dielectric substrate so that the array of grooves forms the array of waveguides. Each of the electronic circuits is electromagnetically connected to a corresponding one of the waveguides.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1A is a perspective view showing a first frame;

FIG. 1B is a perspective view showing the first frame in a reversed state;

FIG. 1C is a perspective view showing a dielectric substrate;

FIG. 1D is a perspective view showing the dielectric substrate in a reversed state;

FIG. 1E is a perspective view showing a second frame;

FIG. 1F is an enlarged view showing a feeder portion in the first frame;

DETAILED DESCRIPTION OF THE PREFERRED EMBODIMENTS

Figure 2A:
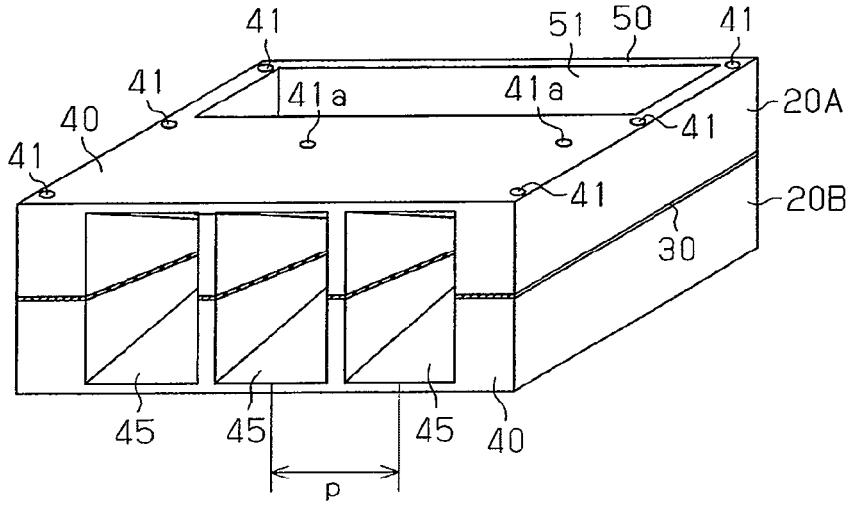
FIG. 2A is a perspective view entirely showing a one-dimensional antenna array.

In the drawings, like numerals are used for like elements throughout.

A first embodiment of an antenna array will now be discussed with reference to FIGS. 1 and 2, which show one example of a one-dimensional antenna array.

As shown in FIG. 2A, the one-dimensional antenna array includes two frames 20A and 20B and a dielectric substrate 30, which is formed by a dielectric. The dielectric substrate 30 is in the form of a film and serves as a printed circuit.

The first frame 20A, which is shown in FIG. 1A, and the second frame 20B, which is shown in FIG. 1E, may each be a metal frame having a conductive surface. Alternatively, the frames 20A and 20B may be formed from an insulative material such as a synthetic resin as long as the surfaces of grooves 42, which function as waveguides, and the surfaces of horn formation recesses 44 are entirely covered by a metal layer. Plating may be performed to form the metal layers. However, the formation of the metal layers is not limited to plating and other processes such as vapor deposition may be performed. Further, the surfaces of the metal layers may be covered by thin insulation films that transmit microwaves.

The frames 20A and 20B each include a generally planar plate portion 40 and a U-shaped frame portion 50, which is connected to the plate portion 40. The frames 20A and 20B are superimposed with the dielectric substrate 30, which is held in between, and fastened together by screws serving as a fastening means (not shown). For example, the screws are inserted into screw insertion holes 41 formed in the frame 20A, screw insertion holes 34 formed in the dielectric substrate 30, and screw insertion holes 41*b* formed in the frame 20B to fasten the frames 20A and 20B and the dielectric substrate 30. Further, to position and align the frame 20A, the dielectric substrate 30, and the frame 20B, knock pins (not shown) are inserted into knock pin holes 41*a* formed in the frames 20A and 20B and knock pin holes 34*a* formed in the dielectric substrate 30.

FIGS. 1B and 1E each show a superimposed surface of the frames 20A or 20B that is superimposed with the dielectric substrate 30. As shown in FIGS. 1B and 1E, each plate portion 40 includes the grooves 42, which have generally rectangular shaped cross-sections, in the superimposed surface. Each groove 42 includes a closed end, which is located closer to the frame portion 50, and an open end, which is located opposite the frame portion 50. Further, a horn formation recess 44 extends from the open end of each groove 42. The horn formation recess 44 widens vertically (frame superimposing direction) and laterally (sideward direction as viewed in FIG. 1) toward the distal end (i.e., the side opposite the frame portion 50). The groove 42 and horn formation recess 44 are connected to each other. The horn formation recess 44 may widen only in the lateral direction. However, it is preferable that the horn formation recess 44 widens in both vertical and lateral directions.

Figure 2B:
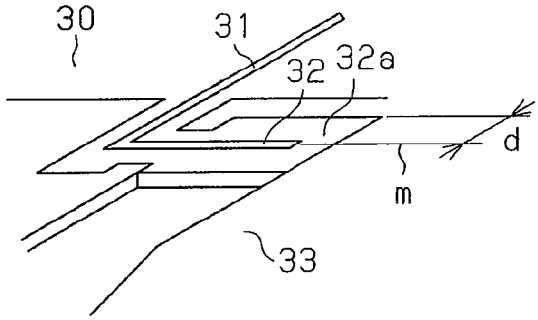
FIG. 2B is an enlarged view showing a feeder portion in the dielectric substrate of FIG. 1C.
Figure 2C:
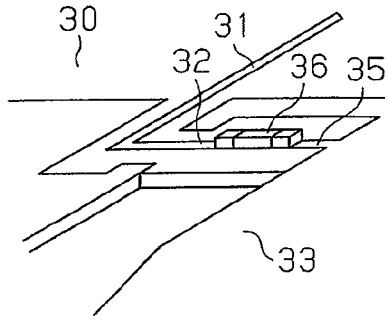
FIG. 2C is an enlarged view showing the feeder portion in the dielectric substrate of FIG. 1C and a mixer diode on the feeder portion.
Figure 2D:
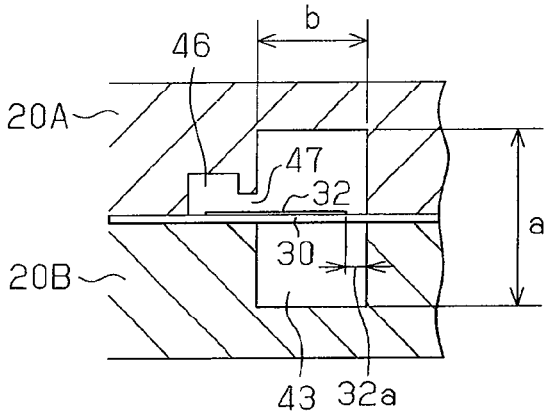
FIG. 2D is a cross-sectional view showing a waveguide.

As shown in FIG. 2A, when the frames 20A and 20B are superimposed, each set of the opposing grooves 42 form a waveguide 43 (refer to FIG. 2D). In this state, each set of opposing horn formation recesses 44 forms a horn 45 connected to the corresponding waveguide 43. In this manner, the one-dimensional antenna array of this embodiment forms a horn antenna.

As a result, as shown in FIGS. 2D and 1E, an array element of waveguides 43 is formed, with waveguides 43 each having a height a, width b, and depth c.

As shown in FIG. 1F, the frame 20A includes a slot 46, which opens in the frame portion 50, next to each groove 42 in the superimposed surface of the plate portion 40 for the passage of a feeder (not shown). A trench 47 connects the slot 46 and the groove 42.

As shown in FIGS. 1A and 1E, in each of the frames 20A and 20B, the space surrounded by the frame portion 50 and the plate portion 40 defines an opening 51. The opening 51 opens in a direction that is perpendicular (vertical direction as viewed in FIGS. 1A to 1F) to both of a direction in which each groove 42 extends (i.e., direction connected the closed and open ends of the groove 42) and a direction in which the grooves 42 are laid out (sideward direction as viewed in FIGS. 1A to 1F).

The dielectric substrate 30 is held between the two frames 20A and 20B by the superimposed surfaces of the plate portions 40 and the superimposed surfaces of the frame portions 50 (edges of the frame portions 50). The dielectric substrate 30 is formed as a thin film so that the line width of a micro-strip line 31 (refer to FIG. 1C) is sufficiently narrower that the waveguides 43. For example, when using a TEFLON (registered trademark) substrate applied to an intermediate frequency of 10 GHz, the thickness is about 0.25 mm. Accordingly, the dielectric substrate 30 has a low mechanical strength. Although a TEFLON substrate is used as the dielectric substrate 30, the material of the dielectric substrate 30 is not limited in any manner. To facilitate understanding, the thickness of the dielectric substrate 30 is shown in an exaggerated manner in FIGS. 1 and 2.

The micro-strip lines 31 are printed onto and arranged next to one another on the upper surface of the dielectric substrate 30 at positions corresponding to the waveguides 43. As shown in FIGS. 1C and 1D, portions facing toward the horn formation recesses 44 are cut out from the dielectric substrate 30. As shown in FIG. 2B, each micro-strip line 31 includes a distal end that is bent and L-shaped to define a feeder portion 32 that extends into the corresponding groove 42. In other words, the feeder portion 32 extends into the groove 42 (waveguide 43) through the gap between the waveguides 43. Further, as shown in FIG. 2C, a mixer diode 36 is arranged on the feeder portion 32. The mixer diode 36 has one end connected to the feeder portion 32 and another end connected to a ground conductor lead line 35, which extends from a ground conductor pattern 33 of the dielectric substrate 30. The feeder portion 32 is spaced from a closed end 42*a* of the waveguide 43 (i.e., conductive end) by distance d (refer to FIGS. 1F and 2B), which is optimized in accordance with the wavelength. In FIGS. 1B and 2B, m denotes the location of the feeder portion 32.

The ground conductor pattern 33 is arranged on the upper surface of the dielectric substrate 30, as viewed in FIG. 1C. Further, the ground conductor pattern 33 is also arranged on most of the lower surface of the dielectric substrate 30, as viewed in FIG. 1D. The ground conductor pattern 33 is not formed at portions corresponding to the waveguides 43 (i.e., grooves 42).

Each micro-strip line 31 is arranged in the corresponding slot 46 and trench 47 (refer to FIG. 1F) in the plate portion 40 of the frame 20A without contacting the frame 20A. In this state, the feeder portion 32 is arranged in the corresponding waveguide 43 as described above. As a result, referring to FIG. 2D, the waveguide 43, which has the height a, width b, and depth c (refer to FIG. 1E), surrounds the corresponding feeder portion 32 (distal end of the micro-strip line 31), mixer diode 36 (refer to FIG. 2C), and ground conductor lead line 35 (refer to FIG. 2C). The mixer diode 36 may be arranged in the middle of the waveguide 43.

The micro-strip lines 31, the feeder portions 32, the ground conductor patterns 33, and the ground conductor lead lines 35 on the dielectric substrate 30 may be formed by performing an etching process to chemically eliminate parts of a metal thin film, a milling process to mechanically remove parts of a metal thin film, a printing process to print a conductive film onto an insulative substrate with a conductive ink, or a growing process to grow a metal thin film on an insulative substrate in a vapor phase or liquid phase.

A microwave coupling system has a resolution of approximately one wavelength. Thus, antennas are arranged in an antenna array at interval p (refer to FIG. 2A), which is longer than one wavelength. The width b of the waveguides 43 (refer to FIG. 2D) is less than the interval p. Thus, even when arranging each slot 46 next to the corresponding waveguide 43 (i.e., grooves 42) together with the trench 47 (refer to FIG. 1F), which serves as an opening through which the micro-strip line 31 extends, the antenna interval p does not have to be increased to provide space for laying out the waveguides 43.

The length of each micro-strip line 31 is not limited. In the portion of dielectric substrate 30 arranged in the opening 51, components necessary for a microwave receiver circuit, such as a frequency filter, an amplifier, and a mixer, are connected to the micro-strip lines 31. Such components may be discrete components. Alternatively, such components may be arranged in a microwave receiver circuit that uses only the micro-strip lines 31. If necessary, semiconductor chips may also be used.

Figure 3:
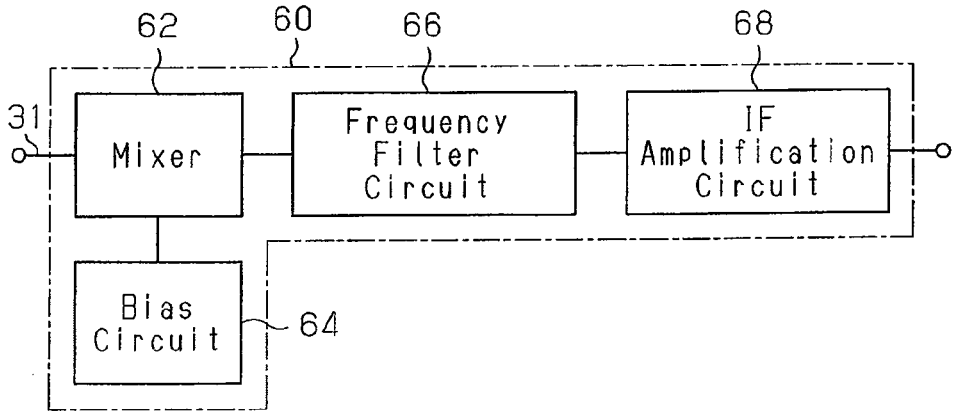
FIG. 3 is a block diagram showing one example of a microwave receiver circuit.

FIG. 3 is a schematic block diagram showing one example of a microwave receiver circuit 60 that is an electronic circuit. The microwave receiver circuit 60 is used with the micro-strip lines 31 of the dielectric substrate 30 to receive electromagnetic waves (microwaves) and select certain electromagnetic waves (microwaves). For example, the microwave receiver circuit 60 includes a mixer 62 connected to the micro-strip lines 31, a bias circuit 64 which applies a bias to the mixer 62, a frequency filter circuit 66 connected to the mixer 62, and an IF amplification circuit 68 connected to the frequency filter circuit 66. In FIG. 3, for the sake of brevity, the micro-strip lines 31 are not shown. However, the microwave receiver circuit 60 may be formed by elements arranged on the micro-strip lines 31 (i.e., on the substrate 30), such as semiconductors, filter elements, capacitors, inductors, and resistors. For example, the mixer 62 may be formed by a mixer diode chip in which case, the mixer diode chip (mixer diode 36) is arranged on the substrate in each waveguide 43. In the same manner, the filter elements, capacitors, inductors, and resistors may be discrete elements. The opening 51 of the dielectric substrate 30 has sufficient space for laying out elements. Thus, active elements such as ICs, transistors, and diodes may be arranged in the space of the opening 51 together with passive elements. This enables the microwave receiver circuit 60 to have high sensitivity.

The functions of the microwave receiver circuit 60 will now be discussed. For example, in a one-dimensional antenna array, a signal having a local oscillation frequency generated by a local oscillator (not shown) and an electromagnetic wave (microwave) are both received by the horns 45. The microwave receiver circuit 60 mixes received signals with the mixer 62 (mixer diode 36 of FIG. 2C) in each waveguide 43 to perform frequency conversion. The bias circuit 64 applies a bias to the mixer 62 so that the mixer 62 mixes the received signals at an optimal operational point even if the power of the local oscillation frequency is low. The frequency filter circuit 66 selects (filters) the necessary intermediate frequency (i.e., desired intermediate frequency) from the frequency-converted signal. The frequency filter circuit 66 is formed by a bandpass filter, a lowpass filter, a highpass filter, or a combination of these filters. The IF amplification circuit 68 amplifies the obtained intermediate frequency and outputs the amplified signal to a core wire in a coaxial cable connected via an external terminal (not shown).

The discussion will now return to FIGS. 1 and 2.

Each frame portion 50 includes the opening 51. Thus, after assembling the one-dimensional antenna array by holding the dielectric substrate 30 between the two frames 20A and 20B, the components of the receiver circuit 60 are connectable to the micro-strip lines 31 via the opening 51. The opening 51 is just for a space of circuit. The part of ground pattern of the printed circuit can be a solid metal in order to cool down active elements.

Power lines, signal lines, and external terminals (not shown) for microwaves that are connected to the dielectric substrate are connected to the frame portion 50 of each of the frames 20A and 20B. As shown in FIG. 1B, the frame portion 50 of the frame 20A includes terminal receptacles 70 for receiving the external terminals at the side facing toward The frame 20B. Thus, even if the mechanical strength of the dielectric substrate 30 is low, the frame portion 50 of the frame 20A (and the frame portion 50 of the frame 20B) ensures mechanical strength for connection of the external terminal.

Application examples of the one-dimensional antenna array will now be discussed with reference to FIG. 4.

Application Example 1

Figure 4:
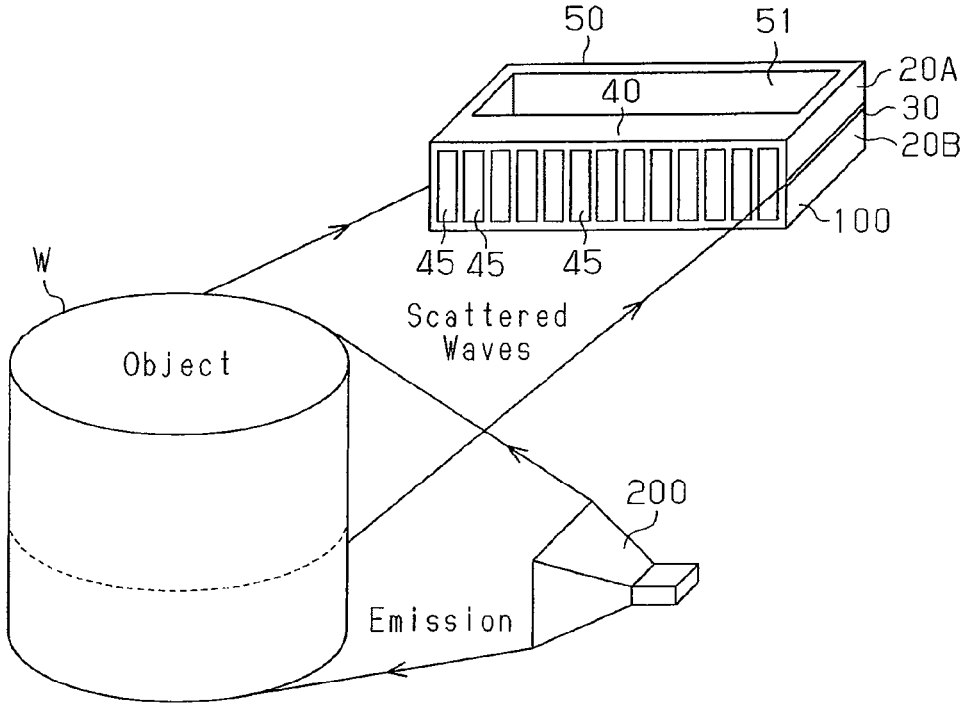
FIG. 4 is a schematic perspective view showing an application example of a one-dimensional antenna array.

FIG. 4 is a schematic diagram showing an example of a one-dimensional antenna array 100, which has the structure shown in FIGS. 1 and 2, applied to microwave computerized tomography (CT). As shown in FIG. 4, an object W, which is the detected subject, has a shape that is uniform in the vertical direction. In this case, microwaves are emitted from a microwave generator 200 toward the object W. Then, the one-dimensional antenna array 100 arranged near the object W receives scattered waves from the object W. Each microwave receiver circuit 60 processes the received scattered waves and sends the processing results to a computer (not shown). The computer reconfigures a cross-sectional image of the object W based on the input signals.

Application Example 2

Another application example of the one-dimensional antenna array 100 will now be discussed with reference to FIG. 5, which shows an example of a two-dimensional antenna array 300. The two-dimensional antenna array 300 is formed by superimposing a plurality of one-dimensional antenna arrays 100 in a direction perpendicular to the direction in which the waveguides 43 are laid out in each one-dimensional antenna array 100. The two-dimensional antenna array 300 functions as a two-dimensional detector that can be applied to, for example, microwave imaging. Microwave imaging detects plasma with microwaves to capture the image of an object.

It is preferable that an imaging optical system 400 be arranged in front of the two-dimensional antenna array 300. A concave mirror or plastic lens may be used as the imaging optical system 400.

In this case, electromagnetic waves (microwaves) RF from an object are imaged on the two-dimensional antenna array 300 via the imaging optical system 400. It is preferable that a half mirror 500 be arranged in front of the imaging optical system 400. The half mirror 500 transmits and directs the electromagnetic waves (microwaves) RF toward the imaging optical system 400. Further, the half mirror 500 reflects a microwave LO, which has a local oscillation frequency and which is generated by a local oscillator (not shown). As a result, the local oscillation frequency wave LO and the electromagnetic waves (microwaves) RF imaged by two-dimensional antenna array 300 are mixed to generate intermediate frequency signal by each antenna of the two-dimensional antenna array 300 and processed by the microwave receiver circuit 60.

In this manner, microwave imaging is enabled with the two-dimensional antenna array 300. Microwave imaging is applied as a high sensitivity receiver to a wide variety of fields, such as nondestructive tests, medical diagnoses, temperature imaging for low temperature detection. The two-dimensional antenna array 300 is applicable to microwave imaging.

The antenna array of the preferred embodiment has the advantages described below.

(1) The one-dimensional antenna array includes the two frames 20A and 20B. The frames 20A and 20B each include the plate portion 40 and the frame portion 50. The plate portion 40 includes the grooves 42, each having an open end and a closed end 42*a*. The frame portion 50 is formed next to the closed ends 42*a* of the grooves 42. The frame portion 50 includes the opening 51, which opens in the direction perpendicular to the direction in which the grooves 42 extend and the direction in which the grooves 42 are laid out next to one another. The two frames 20A and 20B are superimposed with the dielectric substrate 30 held between the plate portions 40 and the frame portions 50. The opposing grooves 42 of the frames 20A and 20B form an array of waveguides 43. The dielectric substrate 30 holds the microwave receiver circuits 60, which include the micro-strip lines 31 (feeder lines) and discrete active elements that are exposed from the opening of the frame portions 50. The microwave receiver circuits 60 are electromagnetically connected to the corresponding one of the waveguides 43.

Accordingly, even when the microwave receiver circuits 60, which include the discrete active elements, are arranged on the dielectric substrate 30 and joined integrally with he waveguides 43, space for accommodating the active elements are ensured in the opening 51 of each frame portion 50. This eliminates the need for semiconductor integrated circuit fabrication techniques used for micro-fabrication of the microwave receiver circuits 60 arranged on the dielectric substrate 30 and enables the use of discrete active elements, which are optimal for mass production. Further, the production of a prototype for such an antenna array is facilitated.

The sandwich structure of the one-dimensional antenna array formed by the first frame 20A, the dielectric substrate 30, and the second frame 20B obtains a high mechanical strength. Further, the pitch (interval p) between the antennas arranged next to one another may be minimized to the wavelength limit. Thus, the antenna array has high spatial resolution.

The superimposed surface of the plate portion 40 lying between the grooves 42 is superimposed on the dielectric substrate 30. This prevents radio wave interference between antennas. Accordingly, the one-dimensional antenna array may be used as a wideband antenna that performs frequency sweeping while preventing interference between antennas.

The dielectric substrate 30 is held between the edges of the frame portions 50. Thus, the dielectric substrate 30 may be stretched even though the dielectric substrate 30 is a thin film of a printed circuit. As a result, electronic circuit elements are stably fixed to the dielectric substrate 30, and the one-dimensional antenna array has high mechanical strength.

(2) In each plate portion 40, the horn formation recesses 44 are each formed so as to widen from the open end of the corresponding groove 42 to the distal end (opposite to the open end). The horn formation recess 44 is wider than the groove (waveguide 43) in at least the lateral direction and preferable in both lateral and vertical directions. When the two frames 20A and 20B are superimposed with the dielectric substrate 30, the horn formation recesses 44 of the plate portions 40 form the horns 45, which are connected to the waveguides 43. As a result, the one-dimensional antenna array functions as a horn antenna array having advantage (1).

(3) The microwave receiver circuits 60 are arranged on the dielectric substrate 30. As a result, the antenna array (or horn antenna array) including the one-dimensional antenna array has advantage (1) or (2).

(4) The dielectric substrate 30 is commonly shared by the microwave receiver circuits 60 that are connected to the waveguides 43 and used to form the one-dimensional antenna array. This facilitates the production of the one-dimensional antenna array having advantages (1) to (3).

(5) When forming the frames 20A and 20B with metal frames, the frames 20A and 20B may easily be manufactured by performing machining or electrical discharging. Further, the frames 20A and 20B only need to be superimposed to be joined together. This facilitates the production of the one-dimensional antenna array. Further, in the frames 20A and 20B, the horn formation recesses 44 and the grooves 42, which are used to form waveguides, are open. Thus, the frames 20A and 20B may be formed from metal using a pressed metal plate, which has a mechanical strength, or cast metal. Alternatively, the frames 20A and 20B may be formed from a synthetic resin through injection molding. When forming the frames 20A and 20B with an insulative material such as a synthetic resin, the surfaces of at least the grooves 42 and the horn formation recesses 44 must be covered by conductive (metal) plating. Further, in the dielectric substrate 30, the micro-strip lines 31 and the ground conductor pattern 33 may be patterned (printed) onto a dielectric film (printed circuit) with a conductive ink. Accordingly, an antenna array may be manufactured with significantly low costs.

(6) When the microwave receiver circuits 60 are arranged on the dielectric substrate 30 in a state exposed from the opening 51 of a frame portion 50, to prevent interference between circuits, it is preferable that a small gap be formed for each circuit so as to arrange a shield plate between the circuits. Alternatively, to improve the characteristics or reduce the influence of unnecessary electromagnetic waves, each circuit region in the openings may be covered by an electromagnetic wave absorption material or by a conductive plate.

Figure 5:
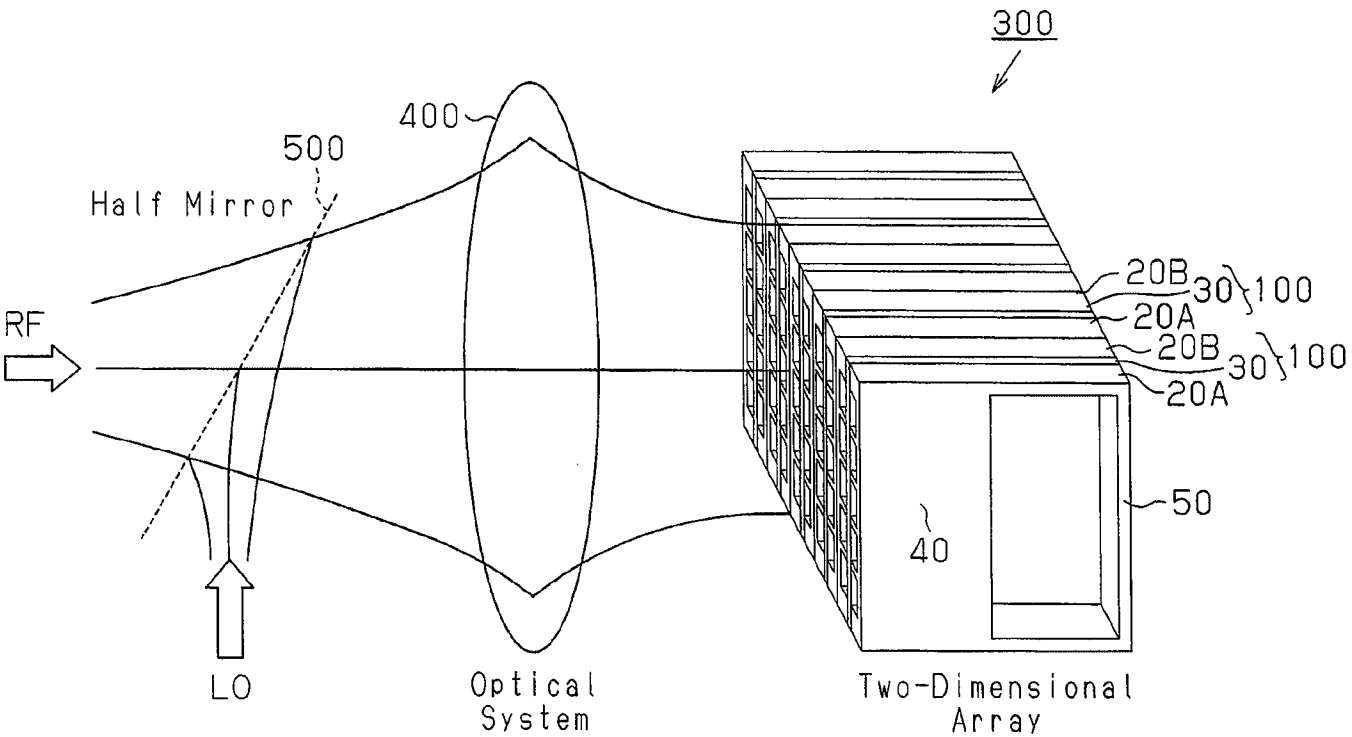
FIG. 5 is a perspective view showing an application example using a two-dimensional antenna array.

(7) By superimposing the one-dimensional antenna array 100, the two-dimensional antenna array 300 shown in FIG. 5 may easily be manufactured.

(8) In the one-dimensional antenna array, each waveguide 43 includes the horn 45. Thus, the one-dimensional antenna array 100 has a high gain and high directivity. Further, in the two-dimensional antenna array 300 shown in FIG. 5 to which the one-dimensional antenna array 100 is applied, a high gain and high directivity are obtained. Additionally, three-dimensional horns are obtained. Thus, in comparison with a tapered slot antenna that functions as a planar horn, a high gain and high directivity are obtained in a more preferable manner.

(9) When minimizing the distance between channels, the directivity of the antenna array widens in the same manner as when cutting out a waveguide. Thus, when an optical system is arranged so that the incident angle of microwaves matches the directivity of the antenna array, the performance of the antenna array may be improved.

It should be apparent to those skilled in the art that the present invention may be embodied in many other specific forms without departing from the spirit or scope of the invention. Particularly, it should be understood that the present invention may be embodied in the following forms.

In the above-described embodiment, the mixer diode 36 is arranged in each waveguide 43. However, this arrangement may be changed as described below. Referring to FIG. 2B, in a one-dimensional (or two-dimensional) antenna array of the second embodiment, a mixer is not arranged on the feeder portion 32 (i.e., in the waveguide 43). The feeder portion 32 is formed by the distal end of a micro-strip line 31 that is bent and L-shaped so as to extend into the corresponding groove 42. As a result, as shown in FIG. 2D, the waveguide 43 surrounds the feeder portion 32. The waveguide structure, which functions in the same manner as a structure including a waveguide and a coaxial converter, transmits and receives microwaves polarized in the horizontal direction. That is, the waveguide 43 is electromagnetically connected to the micro-strip line 31 to propagate signals. A gap 32*a* is formed between the feeder portion 32 and the ground conductor pattern 33 to prevent contact therebetween. When the gap 32*a* is too wide, this would lower sensitivity. Thus, the gap 32*a* should be about 30% the width b of the waveguide. The waveguide 43 is spaced from the closed end 42*a* (i.e., conductor end) by distance d (refer to FIGS. 1F and 2B), which is optimized in accordance with the wavelength. In FIGS. 1F and 2B, m denotes the location of the feeder portion 32. The second embodiment is effective for receiving low-frequency microwaves since the attenuation of micro-strip lines increases as the frequency of microwaves increases.

In the second embodiment, a mixer 62 arranged on the micro-strip line 31 mixes the electromagnetic waves (microwaves) received by the horns 45 with signals having local oscillation frequencies and generated by a local oscillator (not shown) to undergo frequency conversion. This eliminates the need for the half mirror 500 of FIG. 5. Further, the strong local oscillation frequency signals may be used. This eliminates the need for the bias circuit 64. Additionally, a mixer other than a simple diode such as the mixer diode 36 is usable.

The present examples and embodiments are to be considered as illustrative and not restrictive, and the invention is not to be limited to the details given herein, but may be modified within the scope and equivalence of the appended claims.

What is claimed is:

1. A two-dimensional antenna array for microwave imaging comprising:

a plurality of one-dimensional antenna arrays superimposed to form the two-dimensional antenna array for microwave imaging, each of the one-dimensional antenna arrays comprising:

two frames which form an array of waveguides, each of the frames including:

a plate portion including an array of grooves laid out next to one another in parallel, with each of the grooves having an open end and a closed end, each open end being directed to open in the same direction; and a frame portion arranged adjacent to the plate portion at the closed end side of the grooves, with the frame portion having an opening that opens in a direction perpendicular to both of a direction in which the grooves extend and a direction in which the grooves are laid out;

a dielectric substrate held between the two frames by the plate portion and the frame portion of each of the frames, with the dielectric substrate including an array of feeders and microwave receiver circuits, each microwave receiver circuit having a discrete active element, and the array of microwave receiver circuits being exposed from the opening of at least either one of the frames; and mixers each arranged on a corresponding one of the feeders located within a corresponding one of the waveguides; and micro-strip lines, formed on the dielectric substrate, each connected to the corresponding one of the feeders wherein one of the frames includes slot, each of which is adjacent to a corresponding one of the wavelengths in a corresponding plate portion and opens in the opening of a corresponding frame portion, and trenches, each of which connects a corresponding one of the slots and a corresponding one of the waveguides, wherein each of the micro-strip lines is extracted out of the corresponding waveguide via the corresponding trench and connected to the microwave receiver circuits through the corresponding slot, and wherein the frames are superimposed with the dielectric substrate so that the array of grooves forms the array of waveguides, with each of the microwave receiver circuits being electromagnetically connected to a corresponding one of the waveguides.

2. The two-dimensional antenna array for microwave imaging according to claim 1, wherein each of the frames includes a horn formation recess connected to the open end of each of the grooves, and the horn formation recess widens as the open end becomes farther away, with the horn formation recess forming a horn connected to a corresponding one of the waveguides when the frames are superimposed with the dielectric substrate.

3. The two-dimensional antenna array for microwave imaging according to claim 2, wherein the horn formation recess widens in at least the direction in which the grooves are laid out next to one another as the open end becomes farther away.

4. The two-dimensional antenna array for microwave imaging according to claim 3, wherein the horn formation recess further widens in a direction perpendicular to both of the direction in which the grooves extend and the direction in which the grooves are laid out as the open end becomes farther away.

5. The two-dimensional antenna array for microwave imaging according to claim 2, wherein each of the waveguides in each of the one-dimensional antenna arrays has a width that is less-than the pitch of the horns in the one-dimensional antenna array.

6. The two-dimensional antenna array for microwave imaging according to claim 1, wherein each of the mixers is a mixer diode.

7. The two-dimensional antenna array for microwave imaging according to claim 1, wherein the dielectric substrate is a printed circuit formed as a dielectric film.

8. The two-dimensional antenna array for microwave imaging according to claim 1, wherein the dielectric substrate is partially cut out in accordance with the shape of the grooves in each of the frames.

9. The two-dimensional antenna array for microwave imaging according to claim 2, wherein the dielectric substrate is partially cut out in accordance with the shape of the grooves and the shape of the horn formation recesses in each of the frames.

10. The two-dimensional antenna array for microwave imaging according to claim 1, wherein the frame portion of at least one of the frames includes a receptacle which receives an external terminal that connects a power line, a signal line, and a microwave line to the dielectric substrate.

* * * * *